US007063651B2

(12) United States Patent
Kerry

(10) Patent No.: US 7,063,651 B2
(45) Date of Patent: Jun. 20, 2006

(54) ABDOMINAL EXERCISE DEVICE FOR INVERTED ABDOMINAL EXERCISES

(76) Inventor: Ken Kerry, 200 N. Tustin Ave., Suite 200, Santa Ana, CA (US) 92705

( * ) Notice: Subject to any disclaimer, the term of this patent is extended or adjusted under 35 U.S.C. 154(b) by 0 days.

(21) Appl. No.: 10/382,184

(22) Filed: Mar. 4, 2003

(65) Prior Publication Data

US 2003/0166441 A1 Sep. 4, 2003

Related U.S. Application Data

(63) Continuation-in-part of application No. 10/090,079, filed on Mar. 1, 2002.

(51) Int. Cl.
*A63B 71/00* (2006.01)

(52) U.S. Cl. ..... 482/140; 482/44; 482/148

(58) Field of Classification Search ..... 482/69, 482/23, 43, 140, 54, 904, 907, 44–46, 143, 482/91; 434/255; 602/36; 256/25; 446/227, 446/397; 128/68–71
See application file for complete search history.

(56) References Cited

U.S. PATENT DOCUMENTS

| | | | | | |
|---|---|---|---|---|---|
| 743,914 | A * | 11/1903 | McMurran | ..... | 248/106 |
| 2,713,609 | A * | 7/1955 | Niklason | ..... | 348/373 |
| 4,627,588 | A * | 12/1986 | Block | ..... | 248/163.2 |
| 5,941,806 | A * | 8/1999 | Olschansky et al. | ..... | 482/140 |
| 6,244,991 | B1 * | 6/2001 | Bingham | ..... | 482/69 |
| 6,491,611 | B1 * | 12/2002 | Stearns | ..... | 482/142 |
| 6,743,152 | B1 * | 6/2004 | Weiss | ..... | 482/38 |
| 2002/0147087 | A1 * | 10/2002 | Tollner | ..... | 482/147 |

* cited by examiner

*Primary Examiner*—Lori Amerson
(74) *Attorney, Agent, or Firm*—Cislo & Thomas, LLP

(57) ABSTRACT

An exercise device allowing a user to exercise his abdominal region by lying on his back while extending his arms generally upwards is disclosed. The device has a hand-gripping member positioned generally above the user's head for the user to grip while exercising. The hand-gripping member allows for a wide range of motion which may include side-to-side, front-to-back, diagonal, and/or rotational motion. This enables the user can exercise his abdominal region by moving in a variety of different directions, while keeping his arms extended.

4 Claims, 12 Drawing Sheets

ABDOMINAL EXERCISE DEVICE FOR INVERTED ABDOMINAL EXERCISES

CROSS-REFERENCES TO RELATED APPLICATIONS

This patent application is a continuation in part of U.S. patent application Ser. No. 10/090,079 filed Mar. 1, 2002 for ABDOMINAL EXERCISE DEVICE FOR INVERTED ABDOMINAL EXERCISES, which application is incorporated herein by this reference thereto.

BACKGROUND OF THE INVENTION

1. Field of the Invention

This invention relates generally to an abdominal exercise device and more particularly to an abdominal exercise device that utilizes one or more sliding motions for the purpose of exercising the abdominal muscles.

2. Description of the Related Art

Various exercising equipment and equipment free methods of exercising have been developed for exercising the abdominal muscles. Abdominal muscles are generally difficult to isolate and strengthen. Many hours and years of exercise are generally necessary to produce a significant effect on the abdominal musculature. Exercising these muscles may create strain and pressure on the back and neck muscles, depending on the technique used. Additionally, failure to maintain consistent and proper alignment while exercising the abdominal muscles may result an ineffective workout as well as injury.

SUMMARY OF THE INVENTION

An exercise device according to the present invention allows a user to exercise his abdominal region by lying on his back while extending the arms away from the body. The device has a hand-gripping member positioned generally above the user's head which the user grips while exercising. The force which the user exerts on the gripping element reduces the strain and pressure on the user's neck and back muscles, thus providing an isolated work out for mainly the abdominal muscles. The hand-gripping member allows for a wide range of motion which may include side-to-side, front-to-back, diagonal, and/or rotational motion. As such the user can exercise his abdominal region by moving in a variety of different directions, while keeping his arms extended. The device additionally provides the user with a technique of achieving proper and consistent alignment for achieving maximum results.

OBJECTS OF THE INVENTION

It is an object of the present invention to provide an exercise device for working mainly the abdominal muscles.

It is another object of the present invention to provide an exercise device for working mainly the abdominal muscles by enabling a user to move the upper body according to a wide range of motions.

It is yet another object of the present invention to provide an exercise device which allows the user to achieve maximum extension of the arms while exercising mainly the abdominal muscles.

These and other objects and advantages of the present invention will be apparent from a review of the following specification and accompanying drawings.

DESCRIPTION OF THE PREFERRED EMBODIMENT(S)

Figure 1:
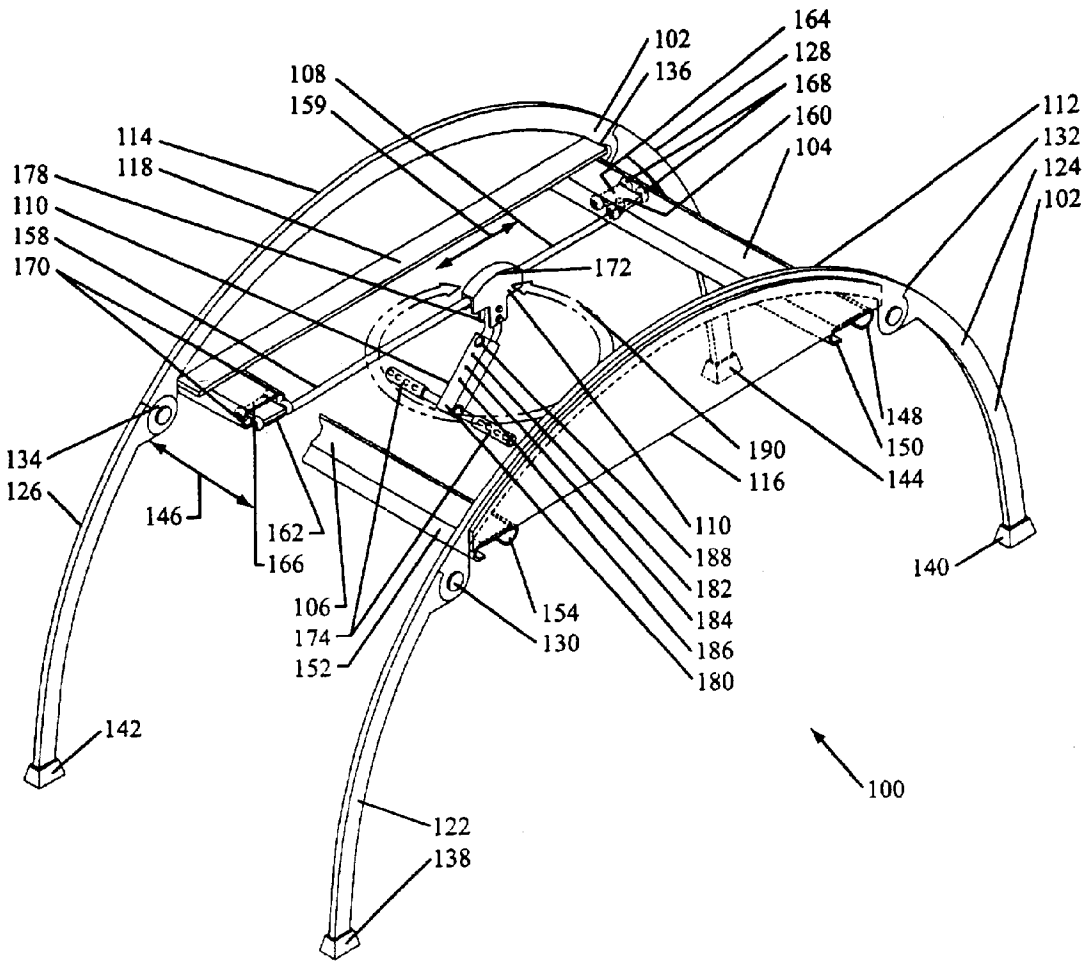
FIG. 1 is a perspective view of an abdominal exercise device according to a first embodiment of the present invention.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

An exercise device according to the present invention allows a user to exercise his abdominal region by lying on his back while extending his arms generally upwards. The device has a hand-gripping member positioned generally above the user's head for the user to grip while exercising. The hand-gripping member allows for a wide range of motion which may include side-to-side, front-to-back, diagonal, and/or rotational motion. As such the user can exercise his abdominal region by moving in a variety of different directions, while keeping his arms extended.

FIGS. 1–4 illustrate an exercise device 100, for generally working the abdominal region, according to a first embodiment. The device 100 generally comprises a frame 102, first and second guiding members 104, 106 oppositely mounted on said frame 102, a third guiding member 108 slidably mounted on the first and second guiding members, and a hand-gripping member 110 slidably mounted on the third guiding member.

Figure 2:
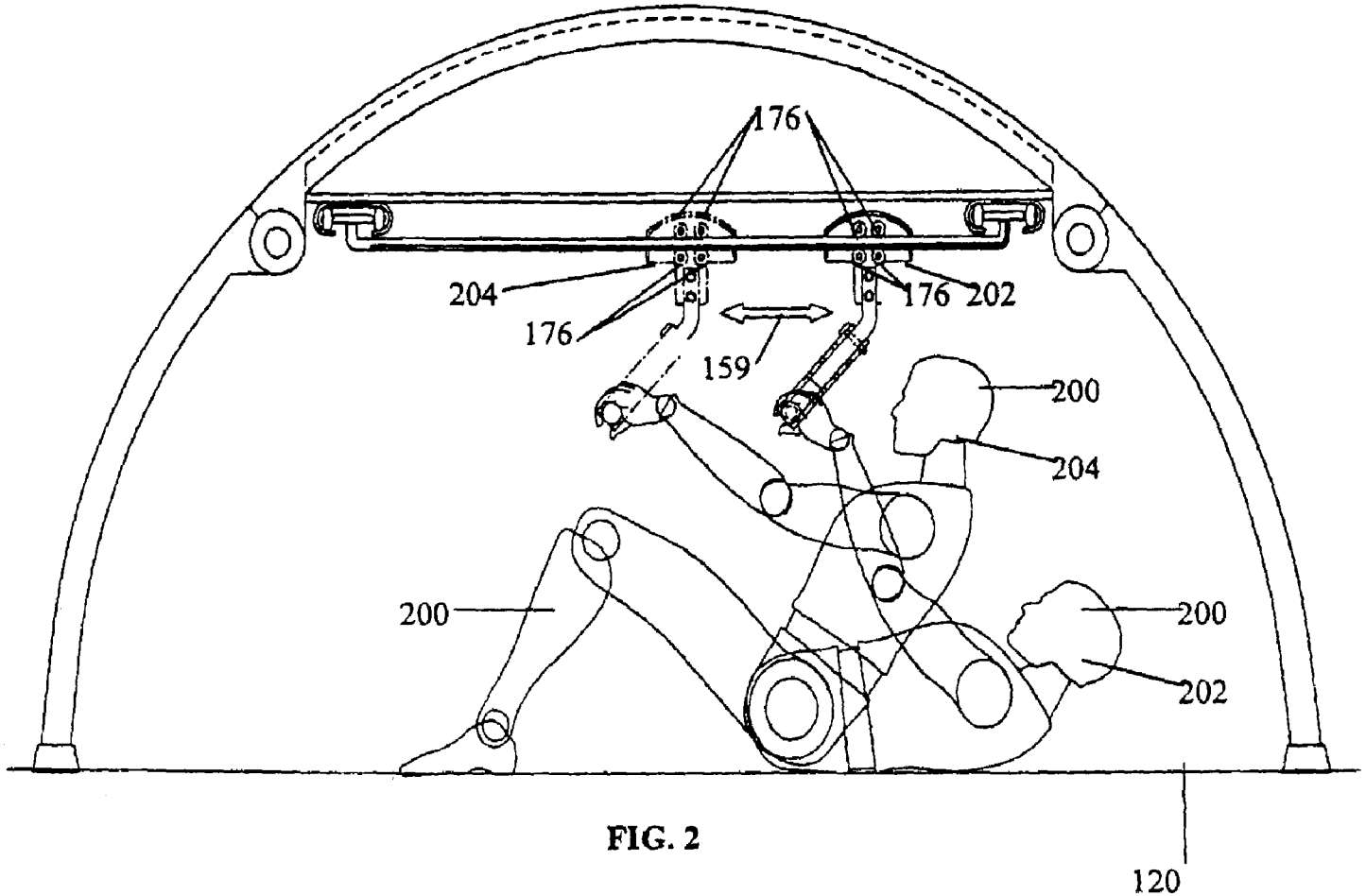
FIG. 2 is a side elevational view of the exercise device of FIG. 1, including a user exercising according to one method of exercise.

The frame 102 functions to provide a mounting for the guiding members and hand-gripping member, such that the hand-gripping member is positioned above the user's head while the device is freestanding on a surface 120. The frame includes support members, 112 and 114, for supporting an oppositely disposed pair of mounting members 116, 118 on which the first and second guiding members 104, 106 are mounted. The support members 112, 114 have leg members, 122, 124, 126, 128, such that the device is freestanding. The leg members 122, 124, 126, 128, may be made foldable, (e.g. via hinge joints, 130, 132, 134, 136, as shown in FIGS. 1 and 2) such that the device can be compacted for easier storage or transportation when not in use. The leg members 122, 124, 126, 128, may further include base elements, 138, 140, 142, and 144, as shown in the Figures.

The frame 102 is preferably metal, but may be made from any suitable rigid material. Although the frame, as illustrated in FIGS. 1 and 2, shows the support members 112, 114 as being arc shape, any suitable design for providing support to the mounting members 116, 118 may be used. For example, the frame may have straight legs extending perpendicularly downwards from the mounting members. Additionally, the mounting members 116, 118 may be secured to the supporting members, and the first and second guiding members may be secured to the mounting members, via any suitable method including bolting, welding, or a wedging or otherwise locking mechanism, or may form an integral unit therewith.

The first and second guiding members 104, 106 provide parallel tracks or rails on which the third guiding member 108 may freely slide side-to-side, as indicated by the arrow 146 in FIG. 1. According to a preferred embodiment, the guiding members 104 and 106 each include brackets 148, 150, and 152, 154, respectively, disposed on a flat surface 156 and 158 of each guiding member for receiving rotating members disposed on the third guiding member 108. Although the brackets 148, 150, and 152, 154 are illustrated in the figures as oriented downwards with respect to the surfaces 156, 158, they may also be configured upwardly, or inwardly (see FIG. 12). Furthermore, the second guiding member 106 is shown broken in FIG. 1 for the purpose of illustration; however, it is to be understood that the member 106 is an unbroken, continues piece.

The third guiding member 108 may comprise a bar 158 extending between the first and second guiding members, and rotating members 160, 162 disposed at either end of the bar for sliding along the brackets 148, 150, and 152, 154 of the first and second guiding members 104, 106. The rotating members 160, 162 may each comprise a surface 164 and 166, respectively, and a set of wheels 168 and 170, each set comprising two pairs of wheels, oppositely disposed across the respective surface 164 and 166, for sliding along the brackets 148, 150, and 152, 154 of the respective guiding member 104, 106.

Figure 3:
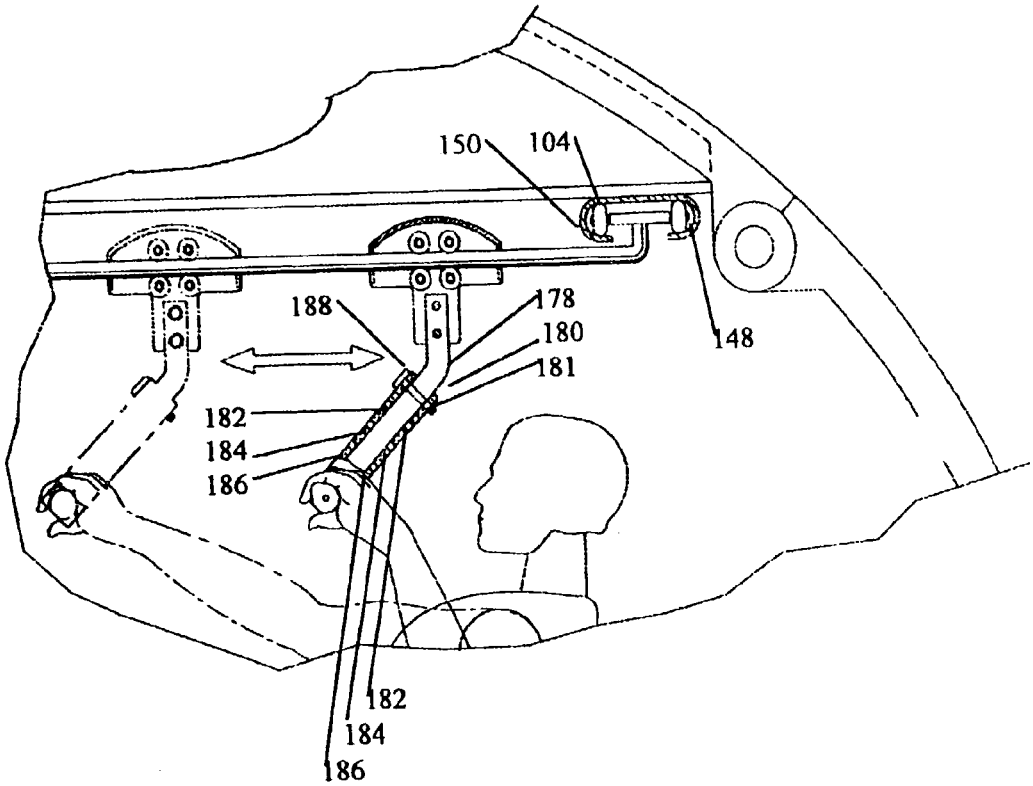
FIG. 3 is an enlarged sectional view of the third guiding member and hand-gripping member of the exercise device of FIG. 1.
Figure 4:
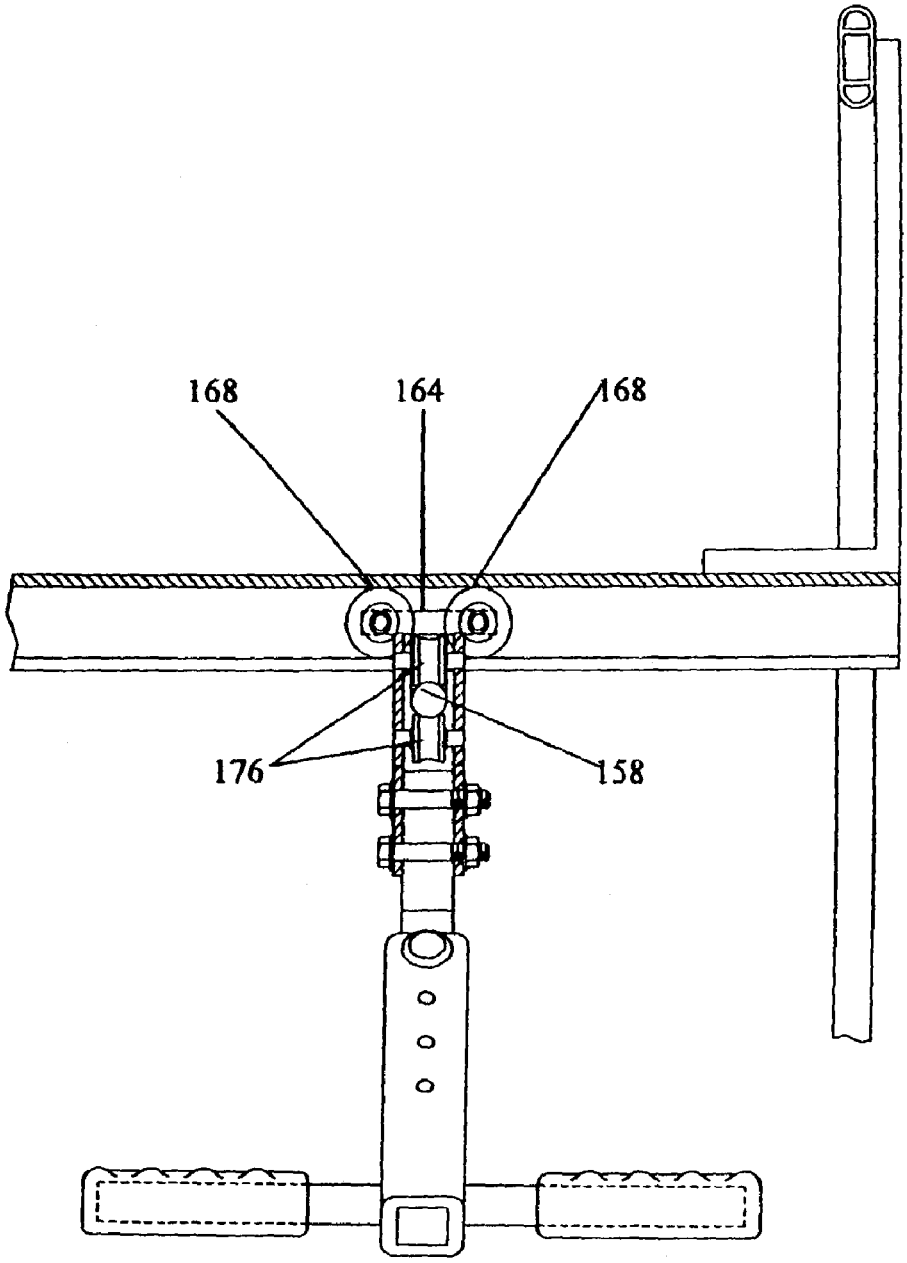
FIG. 4 is a front sectional view of the exercise device of FIG. 1.

The hand-gripping member 110 comprises a slidable member 172 coupled to an element which the user can grip, such as handles 174. As shown in FIGS. 2–4, the slidable member 172 may be made slidable on the bar 158 of the third guiding member 108, via wheels 176, which contact the bar 158 on top and bottom sides of the bar, such that the slidable member can slide front-to-back on the bar 158, as indicated by the arrow 159 in FIG. 1. (Alternate methods for providing slidable elements will be illustrated by alternate embodiments described herein)

As best illustrated in FIG. 3, the slidable member 172 may have a hollowed out portion for coupling the slidable member to the handles, by inserting a narrower connector piece 178 into the hollowed out portion, the hollowed out portion and connector piece having corresponding holes for bolting or screwing the pieces together. Additionally, the distance of the handles 174 from the surface 120 may be made adjustable by providing a hollowed rod 180 extending from the handles and having several locking holes 181, 182, 184, 186 for locking the handles into a corresponding hole of the connector piece via a locking pin 188.

As the hand-gripping member 110 can slide from side-to-side, and from front-to-back, curved or circular motion can be achieved (as indicated by the arrow 190 in FIG. 1), as well as diagonal motion.

FIG. 2 illustrate a user 200 exercising on the device 100 by moving his body from a first position 202, in which the user's upper body is positioned substantially flat against the surface 120, to a second position 204 in which the user's upper body is lifted forwards and up. (The device 100 is preferably smaller in scale with respect to the user's body then what is shown in the figure).

The user's hands extend to grip the handles 174 as the user exercise. The grip handles 174 move from the first position 202 to the second position 204 along with the user 200, such that the user's arms can remain extended at substantially the same length, as the user 200 moves. Thus the user's abdominal region is exercised while the arms can be kept fully extended away from the user's body. The force which the user exerts on the gripping element reduces the strain and pressure on the user's neck and back muscles, thus providing an isolated work out for mainly the abdominal muscles. Additionally, the user is guided through proper and consistent alignment while exercising.

While the user 200 is illustrated in FIG. 2 as moving his upper body in a front-to-back motion, many different exercise techniques are possible. For example, the user can move his raised upper body in a side-to-side motion, front-to-back motion, diagonal motion, or in a circular or semi-circular motion, or in a combination of different motions while keeping the arms fully extended. Additionally, the user can exercise with his legs raised, or flat on the floor, or by raising or crossing one leg. Also, the user can continuously lower and raise his abdominal region off the floor while exercising, preferably while exercising with the arms moving back and forth, or move the abdominal in any other motion to accompany the motion of the arms. Further, the user may exercise while lying on one side instead of flat on his back. Many other methods of exercising will be apparent to one skilled in the art.

An element for providing motion resistance to the hand-gripping member may be included. This may be accomplished by placing a weight on the hand-gripping member, or otherwise providing a friction-bearing element coupled to the hand gripping member, or coupling a spring or rubber band element between the frame and hand-gripping member.

Many different designs for providing a hand-gripping member capable of side-to side, front-to back, and/or rotational motion will be apparent to one skilled in the art. Methods for achieving the desired motion include providing a slidable attachment, spring mounting, pivot or ball attachment, or pendulum attachment coupled between the hand gripping member and frame. The following embodiments will illustrate examples of alternative designs for providing a hand-gripping element capable of the range of motions described herein. It should be understood that the invention is not limited to the examples provided.

Figure 5:
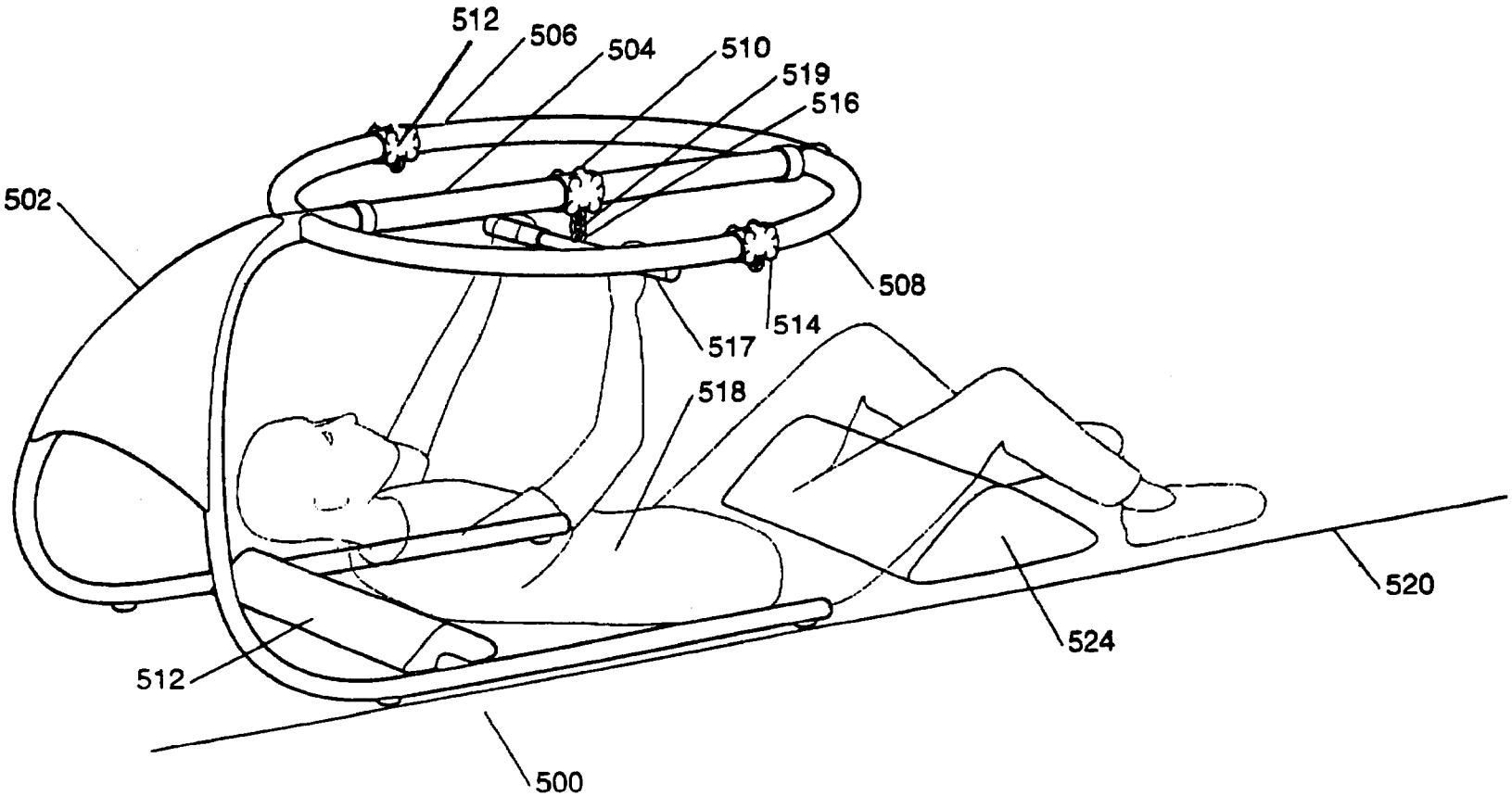
FIG. 5 is a perspective view of an abdominal exercise device according to a second embodiment of the present invention, including a user positioned on the device.

FIG. 5 illustrates an exercise device 500, according to a second embodiment. The device 500 generally comprises a frame 502 supporting guiding members comprising a central guiding member 504, and left and right guiding members 506, 508. The device 500 further comprises slidable members 510, 512, and 514 coupled to the guiding members 504, 506, and 508, respectively, for sliding on the guiding members. A hand-gripping member 516 comprising handles 517 and a chain 519 may be coupled to any one of the slidable members 510, 512, or 514. A hook or any other attachment mechanism can be provided for attaching the chain 519 to the slidable members.

As shown in the figure, the left and right guiding members 506 and 508 may each be semi circular units, forming a continuous circular unit integral with the frame. The central guiding member 504 forms a bar or rod through the center of the circle formed by the left and right guiding members 506, 508.

The slidable members 510, 512, and 514 and guiding members 504, 506, and 508 may each have a smooth surface providing nearly frictionless contact between each guiding member and corresponding slidable member. The surfaces may comprise Teflon, plastic, metal, or other smooth material.

A user 518 of the device 500 is positioned for exercise by lying on a surface 520, with his hands gripping the handles 517 of the hand-gripping member 516. As shown in the figure, cushions for supporting the user on the surface 520 may be provided, including a head cushion 522, which may be coupled to the frame as shown, and a leg cushion 524.

By having the hand-gripping member 516 coupled to the slidable member 510 of the central guiding member 504, the user 518 may exercise his abdominal region using a front-to-back motion, while keeping his hands extended on the handles 517. The user can similarly exercise by moving his upper body in a semi-circular front-to-back motion by having the hand-gripping member 516 coupled to the one of the slidable members of the left or right guiding members 506 or 508.

Having a relatively short chain 519, as illustrated in the figure, effectively confines the available patterns of motion to a two-dimensional plane, substantially parallel to the guiding members 504, 506, 508. By increasing the length of the chain 519, the user can also utilize pendulum motion for other ranges of motion. Such motion may include swing motion which may be side-to-side, front-to-back, diagonal or a combination thereof, or fully circular motion (which is also confined to a plane parallel to the guiding members).

Figure 6:
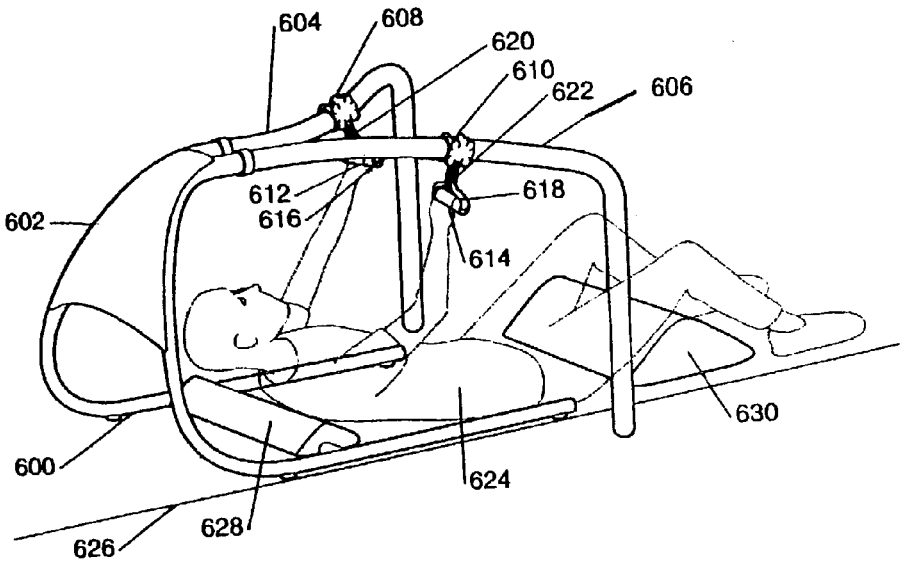
FIG. 6 is a perspective view of an abdominal exercise device according to a third embodiment of the present invention, including a user positioned on the device.

FIG. 6 illustrates an exercise device 600, according to a third embodiment. The device 600 generally comprises a frame 602 supporting left and right guiding members 604, 606. The device 600 further comprises slidable members 608 and 610 coupled to the guiding members 604 and 606, respectively, for sliding on the guiding members. Left and right hand-gripping member 612 and 614 comprising a left and a right handle 616 and 618, and corresponding chains 620 and 622, respectively, may be coupled to the slidable members 608 and 610. A hook or any other attachment mechanism can be provided for attaching the chains 620, 622 to the slidable members.

As shown in the figure, the left and right guiding members 606, 606 together form a "V" shape integral with the frame. Similar to the device 500, the slidable members 608 and 610 and guiding members 604 and 606 may each have a smooth surface providing nearly frictionless contact between each guiding member and corresponding slidable member. The surfaces may comprise Teflon, plastic, metal, or other smooth material.

A user 624 of the device 600 is positioned for exercise by lying on a surface 626, with his left and right hands gripping respective handle 616 and 618. Cushions for supporting the user on the surface 626 may be provided, including a head cushion 628, which may be coupled to the frame as shown, and a leg cushion 630.

The user 624 may exercise his abdominal region using a front-to-back motion, while gripping one of the handles 616, 618 in each hand and tracing along a "V" pattern as the user moves back and forth. A single hand-gripping unit having handles on which the user can grip with both hands can replace either the left or right handle, such that the user can exercise by moving in a left or right front-to-back motion.

Figure 7:
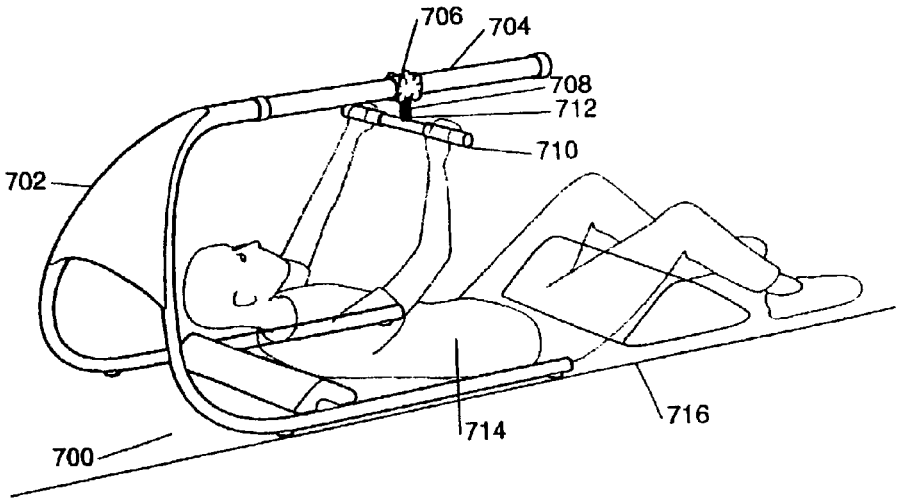
FIG. 7 is a perspective view of an abdominal exercise device according to a forth embodiment of the present invention, including a user positioned on the device.

FIG. 7 illustrates an exercise device 700, according to a forth embodiment. The device 700 generally comprises a frame 702 supporting a centrally extending guiding member 704. The device 700 further comprises a slidable member 706 coupled to the guiding member 704, for sliding on the guiding member. A hand-gripping member 708 comprising handles 710 and a chain 712 may be coupled to the slidable member 706. A hook or any other attachment mechanism can be provided for attaching the chain 712 to the slidable member.

Similar to the devices 500 and 600, the slidable member 706 and guiding member 704 may each have a smooth surface providing nearly frictionless contact between them. The surfaces may comprise Teflon, plastic, metal, or other smooth material.

A user 714 of the device 700 is positioned for exercise by lying on a surface 716, with his hands gripping the handles 710. Cushions for supporting the user on the surface 716 may be provided as shown in the figure. The user 714 may exercise his abdominal region using a front-to-back motion, while gripping the handles 710 to keep his hands fully extended while moving back and forth.

Figure 8:
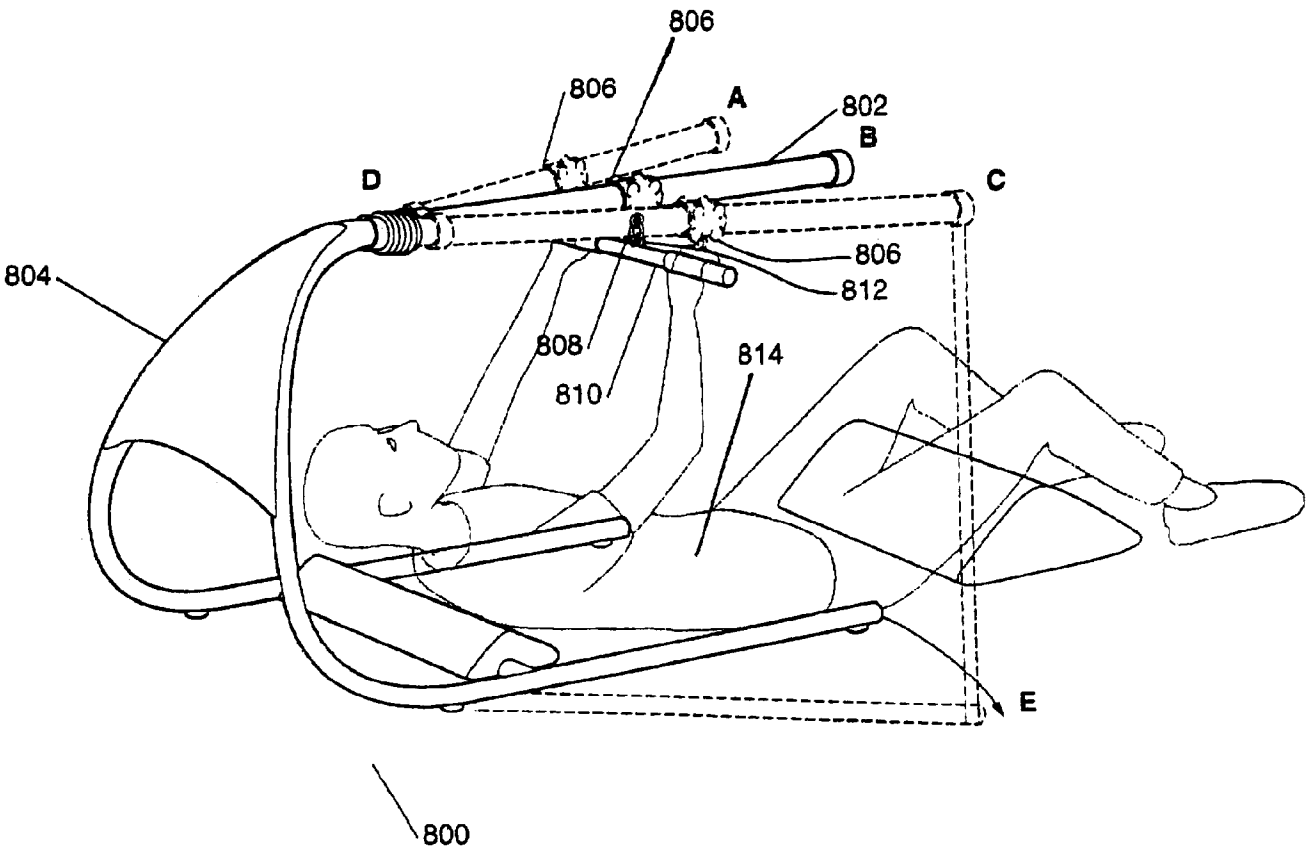
FIG. 8 is a perspective view of an abdominal exercise device according to a fifth embodiment of the present invention, including a user exercising on the device.

FIG. 8 illustrates an exercise devise 800, according to a fifth embodiment. The device 800 is similar to the device 700 of the forth embodiment, except for having a guiding member 802 capable of side-to-side motion via a spring joint mechanism attached to the frame 804, as shown in the figure. (Although not illustrated in the figure, a spring or ball attachment may also be provided for enabling up-and-down and/or rotational movement of the guiding member 802).

As in the device 700, the device 800 also has a slidable member 806 for sliding on the guiding member 802, and a hand-gripping member 808 comprising handles 810 and a chain 812.

A user 814 positioned on the device 800 may exercise his abdominal region using a front-to-back motion, while gripping the handles 810 to keep his hands fully extended while moving back and forth. The user may further cause the guiding member to move side-to-side. Thus, the user can exercise by moving side-to-side, font-to-back, or by combining both side-to-side and front-to-back motion to achieve diagonal, circular, or partially circular motion.

Figure 9:
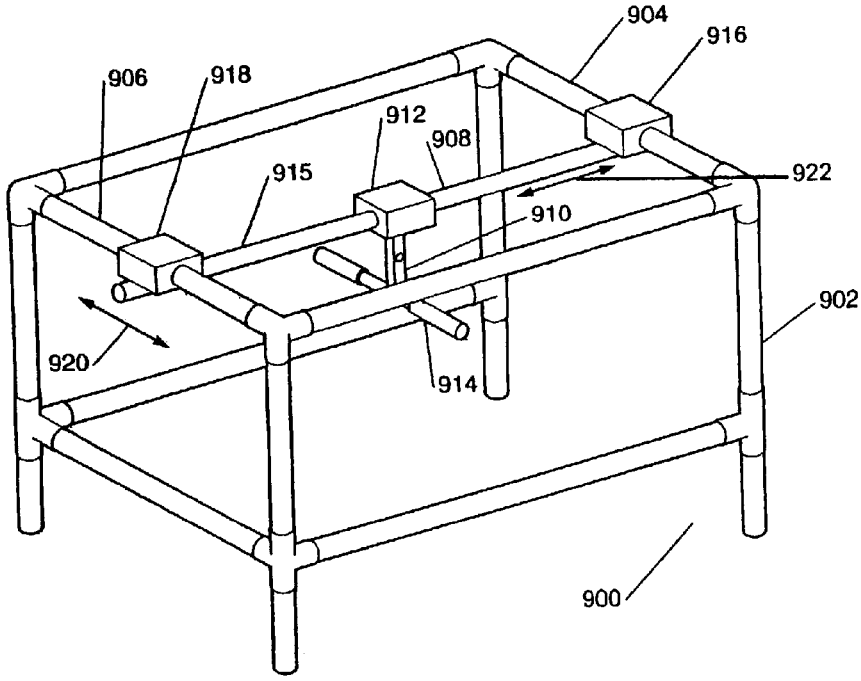
FIG. 9 is a perspective view of an abdominal exercise device according to a sixth embodiment of the present invention.

FIG. 9 illustrates an exercise device 900, according to a sixth embodiment. The device 900 is similar to the device 100 of the first embodiment, in that it generally comprises a frame 902, first and second guiding members 904, 906 oppositely mounted on said frame 902, a third guiding member 908 slidably mounted on the first and second guiding members, and a hand-gripping member 910 slidably mounted on the third guiding member. The hand-gripping member 910 comprises a slidable member 912 and handles 914 which a user can grip.

The first and second guiding members 904, 906 may comprise rails or bars on which the third guiding member 908 may slide. The third guiding member 908 comprises a bar 915 having first and second slidable members 916, 918 on its opposite ends, contacting the first and second guiding members 904, 906, such that the third guiding member 908 may slide from side-to-side, as indicated by the arrow 920.

The slidable members 916, 918 of the third guiding member 908 may be made slidable by providing wheels rotatively guided on the first and second guiding members 904, 906, or by providing smoothly surfaced materials for the slidable members 916, 918 and first and second guiding members 904, 906, such that the slidable members 916, 918, and first and second guiding members 904, 906 are in nearly frictionless contact.

The slidable member 912 of the hand gripping member 910 may similarly be made slidable on the bar 915 of the third guiding member, for moving from front-to-back, as indicated by the arrow 922. Thus, a user can exercise his abdominal region by utilizing front-to-back, side-to-side, diagonal, or circular motion, or a combination thereof, while keeping his arms extended.

Figure 10:
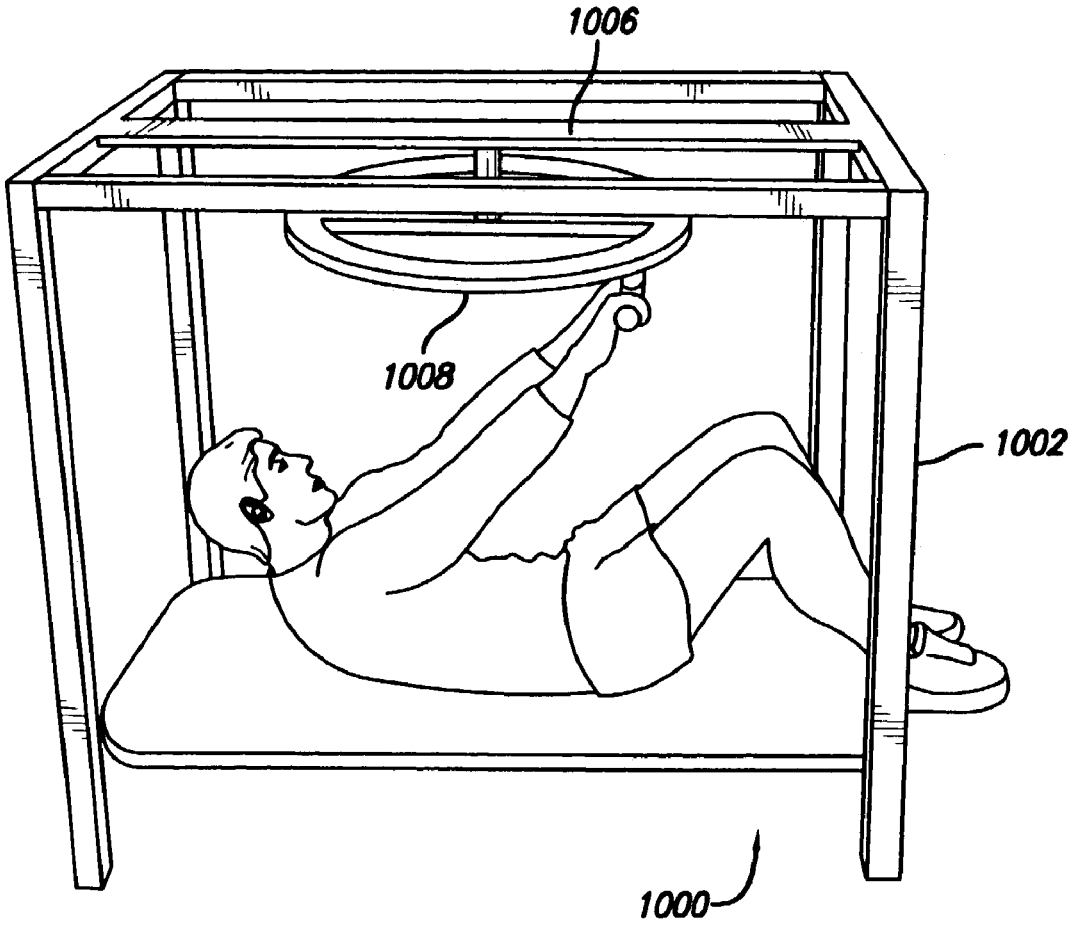
FIG. 10 is a perspective view of an abdominal exercise device according to a seventh embodiment of the present invention, including a user exercising on the device.

FIG. 10 illustrates an exercise device 1000, according to a seventh embodiment, which is similar to the device 500 of the second embodiment, providing an alternate structure for the frame 1002 and circular guiding members 1004, 1006.

Figure 11:
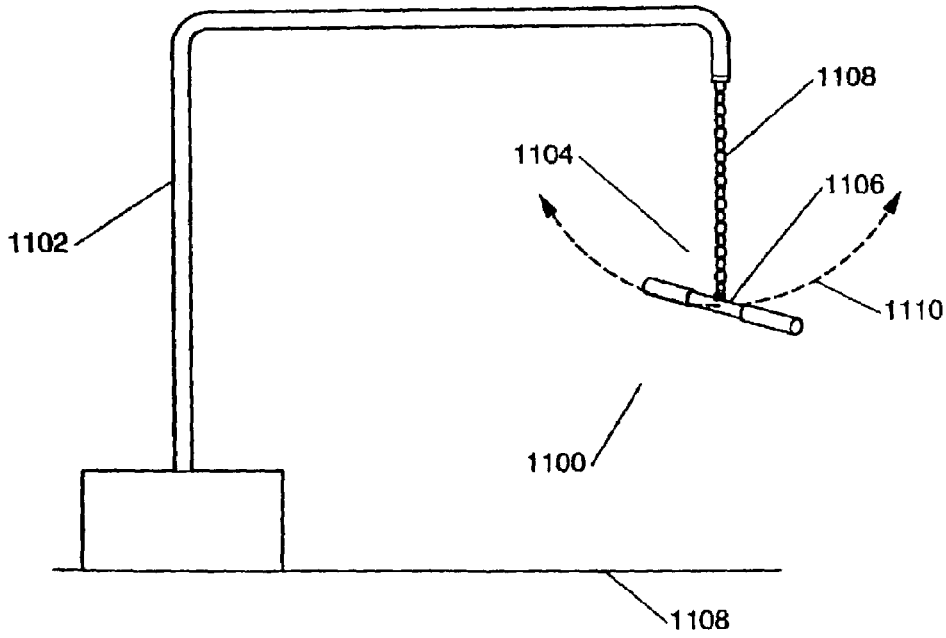
FIG. 11 is a perspective view of an abdominal exercise device according to an eighth embodiment of the present invention.

FIG. 11 illustrates an exercise device 1100, according to an eighth embodiment, comprising a frame 1102 supporting a hand-gripping member 1104 which includes handles 1106 mounted on a long chain 1108. A user can exercise his abdominal region by laying on the surface 1108 with his hands extending to grip the handles 1106, and utilize pendulum or swing motion of the hand gripping member 1104 to move his upper body according to a back-and-forth swing (indicated by the arrow 1110), side-to-side swing, or circular motion.

Figure 12:
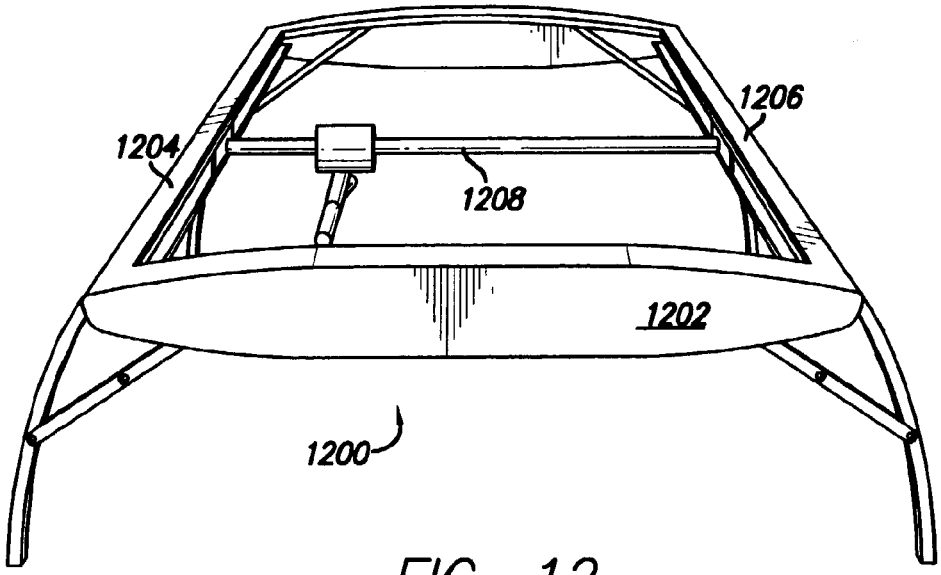
FIG. 12 is a perspective view of an abdominal exercise device according to a ninth embodiment of the present invention.
Figure 13:
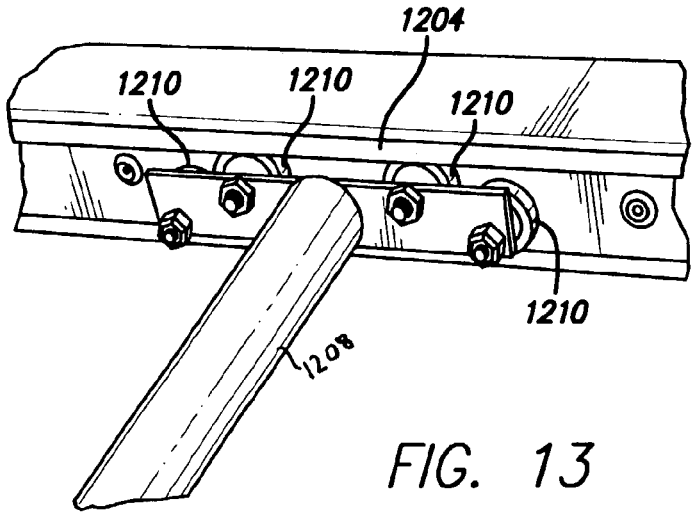
FIG. 13 is an enlarged perspective view illustrating the engagement of the rod guiding member within a rail member of the device of FIG. 12.

FIG. 12 illustrates an exercise device 1200, according to a ninth embodiment, similar to the first embodiment, comprising a foldable frame 1202, having inwardly oriented brackets or rails 1204, 1206, providing parallel tracks on which a rod guiding member 1208 may freely slide. The rod guiding member 1208 may comprise rotating members 1210 which are rotationally engaged within the rails 1204, 1206, as illustrated in FIG. 13.

Figure 14:
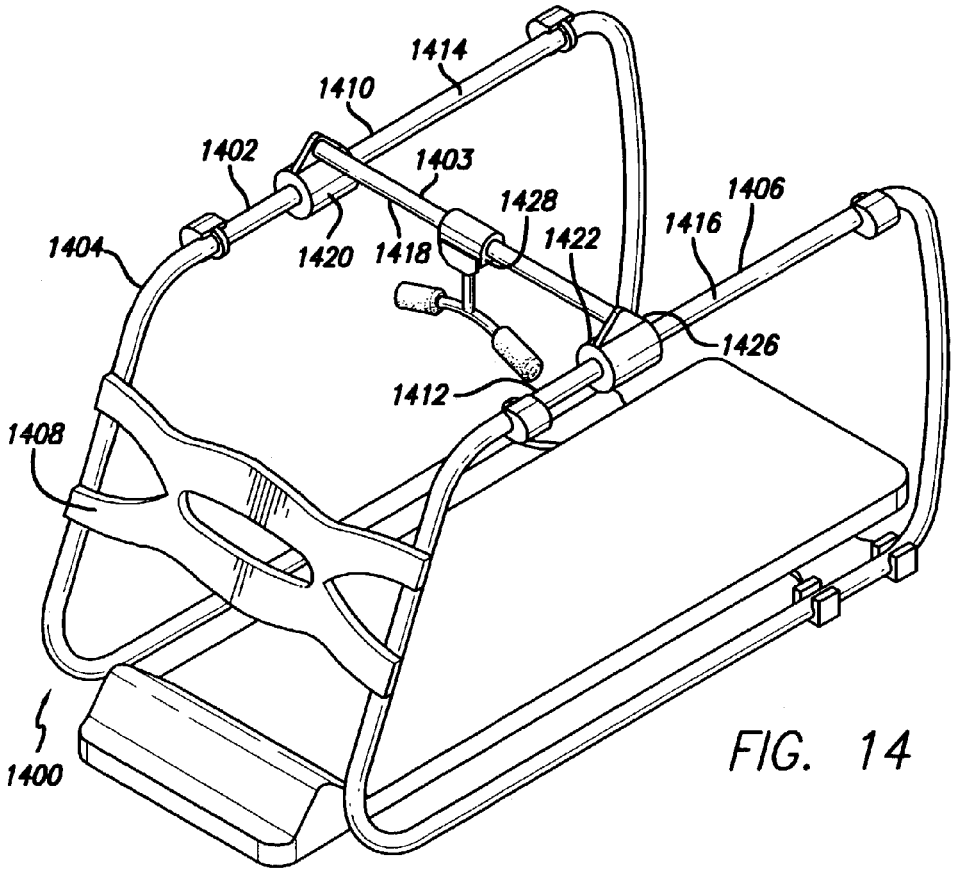
FIG. 14 is a perspective view of an abdominal exercise device according to a tenth embodiment of the present invention.
Figure 15:
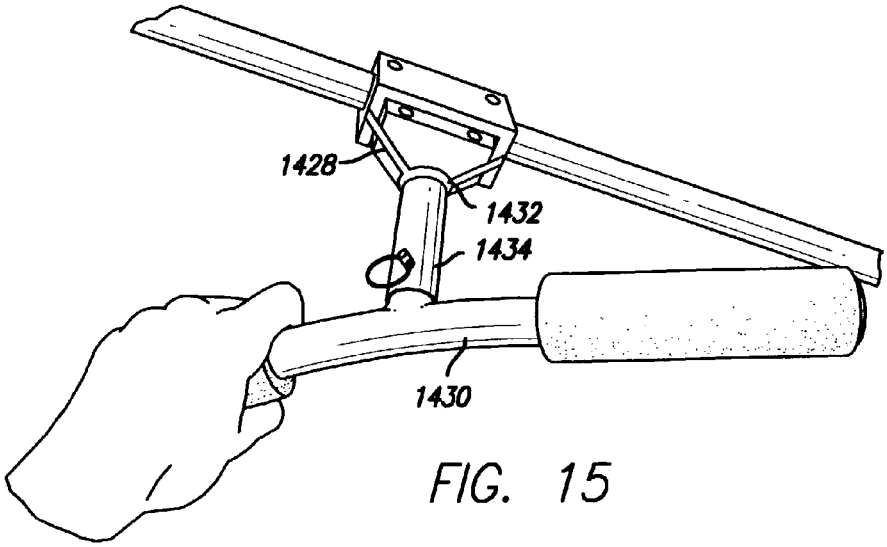
FIG. 15 is an enlarged perspective view of the handlebars of the device of FIG. 14.

FIG. 14 illustrates an exercise device 1400 according to a tenth embodiment. The device 1400 comprises a frame 1402 formed from first and second side panels 1404, 1406, joined by stabilizing rear and bottom panels 1408, 1409, which attach to the rear and bottom rod portions of the side panels, respectively. Semi cylindrical retaining elements 1411 may be provided on the ends of the panels 1408, 1409, such that the panels can be attached and detached for making the device foldable. A mechanism for tightening the attachments may also be provided.

The tops 1410, 1412 of the side panels 1404, 1406 provide first and second rod guiding members 1414, 1416 on which a third guiding member 1418 is slidably mounted via first and second slidable mounting elements 1420, 1422. First and second slidable mounting elements 1420, 1422 form tubular enclosures around the rod guiding members 1414, 1416, and may be provide with inner rotating members or be in frictionless contact with the guiding members 1414, 1416 for enabling the third guiding member 1418 to slide back and forth. The slidably mounting elements 1420, 1422 further comprise extension members 1424, 1426 extending therefrom to which the third guiding member is attached. The guiding member may also be detached from either one or both of the mounting elements 1420, 1422 for making the device foldable.

As illustrated, the third guiding member is a rod on which a third slidable mounting element 1428, similar to first and second mounting elements 1420, 1422 is mounted. Handlebars 1430 are suspended from the third mounting element 1428 via a retaining element 1432 which may include a ball member coupled to an adjustable mounting rod 1434 of the handlebars 1430. Such ball coupling would allow the handlebars to be rotated on the device 1400, such that a user may utilize the twisting motion of the handlebars, as well as the various combinations of back and forth and side to side motions.

While the present invention has been described with regards to particular embodiments, it is recognized that additional variations of the present invention may be devised without departing from the inventive concept.

What is claimed is:

1. An exercise device, comprising:

A hand-gripping member shaped and dimensioned to be gripped by at least one hand of a user while performing abdominal crunches or related muscular exercises, said hand-gripping member being positioned generally above a user's head when the user lies on his back during said crunches or related exercises, said hand gripping member further being capable of side-to-side motion, front-to-back motion, diagonal motion, rotational motion, or a combination thereof, relative to the user, said motion being substantially confined to a plane parallel to a surface on which the device is supported to effectuate said crunches or related exercises; further comprising a frame for supporting said hand-gripping member; first and second rod guiding members oppositely mounted on said frame and a third guiding member having first and second mounting elements on opposite ends thereof that form tubular enclosures around said first and second rod guiding members, whereby said third guiding member is slidably supported on said first and second rod guiding members respectively, wherein said hand-gripping member is slideably suspended from said third guiding member by a retaining element that comprise a ball member such that, when the user lies facing up and grins the hand-gripping member with at least one hand, repeated sliding of the hand-gripping member along the third guiding member causes the user to perform abdominal crunches or related muscular exercises.

2. The device of claim 1 wherein the user exercises by moving his upper body from a first position to a second position, the user's arms being kept extended while gripping the hand-gripping member, wherein in said second position the user's upper body is raised relative to said first position.

3. The device of claim 1 wherein the user exercises by moving his upper body in a side-to-side motion, front-to-back motion, diagonal motion, rotational motion, or a combination thereof, the user's arms being kept extended while gripping the hand-gripping member.

4. The device of claim 1, said hand-gripping member comprising handles which are gripped by the user while exercising, wherein the distance of the handles from said first surface is adjustable.

* * * * *